United States Patent [19]

Vigneau

[11] 4,435,155

[45] Mar. 6, 1984

[54] INFRA-RED RADIANT BURNER

[76] Inventor: David L. Vigneau, 12 Payan St., West Warwick, R.I. 02893

[21] Appl. No.: 484,523

[22] Filed: Apr. 13, 1983

[51] Int. Cl.[3] ..... F23D 13/12

[52] U.S. Cl. ..... 431/328

[58] Field of Search ..... 431/328, 329

[56] References Cited

U.S. PATENT DOCUMENTS

| | | | |
|---|---|---|---|
| 3,008,513 | 11/1961 | Holden | 431/328 |
| 4,035,132 | 7/1977 | Smith | 431/328 |
| 4,189,297 | 2/1980 | Bratko et al. | 431/328 |
| 4,255,123 | 3/1981 | Bishilany et al. | 431/328 |

*Primary Examiner*—Carroll B. Dority, Jr.

*Attorney, Agent, or Firm*—Barlow & Barlow, Ltd.

[57] ABSTRACT

An infra-red radiant burner is disclosed which uses a porous refractory board matrix that is supported by two pairs of frame members that provide a ledge upon which the matrix lies and a peripheral lip means that grips the edge of the matrix. The frame members together with a flat sheet will form between the flat sheet, the frame members and the matrix, a gas-air mixture chamber, while the frame members are made hollow to receive a non-combustible gas which is directed outwardly along a narrow exit path along the sides of the matrix.

5 Claims, 5 Drawing Figures

INFRA-RED RADIANT BURNER

BACKGROUND OF THE INVENTION

In the prior art, there have been a number of approaches to developing infra-red burners, particularly those types of burners which use a fibrous refractory felt burner face that is permeable to a combustible mixture. The basic problem that arises is confining the heat from the infra-red generation to the surface of the matrix and preventing its spreading outside the edge of the matrix face. Examples of some of the prior approaches are seen in the Smith U.S. Pat. No. 4,035,132 and the Bratko et al U.S. Pat. No. 4,189,297. In addition, the problem has been previously addressed in my prior application Ser. No. 399,293 filed July 19, 1982. In that application, which was primarily directed to the concept of utilizing both radiant and convective energy and controlling the convective energy with individually supplied air knives on each of the four sides of the matrix, it was discovered that there were certain constructional features that related to escaping gasses that were not properly addressed.

It is therefore the primary object of the present invention to provide an infra-red burner with the air knife construction, which grips the edge of the matrix in a positive manner to prevent gas leakage, and yet retains the provision for the delivery of air through the air knives around the periphery of the burner.

DESCRIPTION OF THE PREFERRED EMBODIMENT

Figure 1:
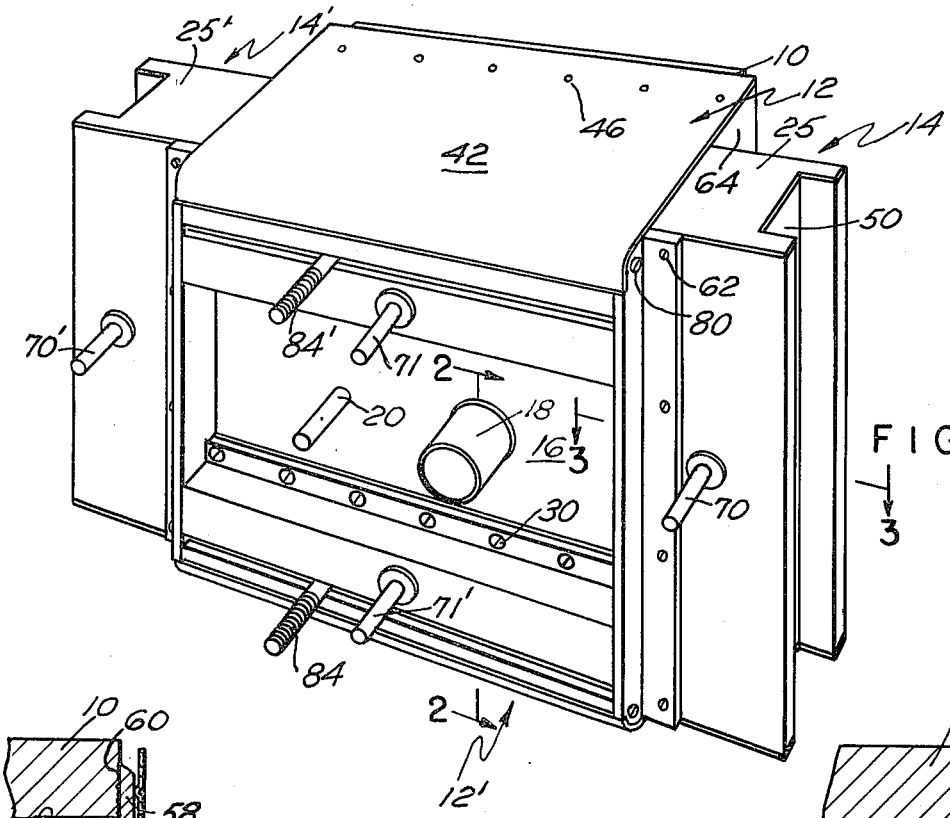
FIG. 1 is a perspective view of the infra-red burner of the invention taken from the back side thereof opposite the matrix.

Referring now to the drawings, the infra-red burner comprises essentially a fibrous refractory matrix 10 which is held in position by a frame which consists of a first frame member 12 and 12' that extends along two opposite sides and which are mirror images of each other, and a second frame member 14, 14' which are mirror images of each other extending along the two other opposite sides, each of these frame members forming a complete enclosure about the four sides of the matrix so as to grip the matrix and to form, as will become apparent, a gas-tight seal with the matrix to prevent the escape of a combustible gas mixture along the gripped edges of the matrix. The frame members receive a flat sheet 16 therebetween which forms a wall so that the area between the sheet 16 and the matrix effectively forms what is known as a combustion mixture plenum. A supply connection for a gas combustion mixture is suitably fitted to the wall plate 16 as by a pipe 18 while a pressure tap pipe 20 is also fitted to the plate 16.

Figure 2:
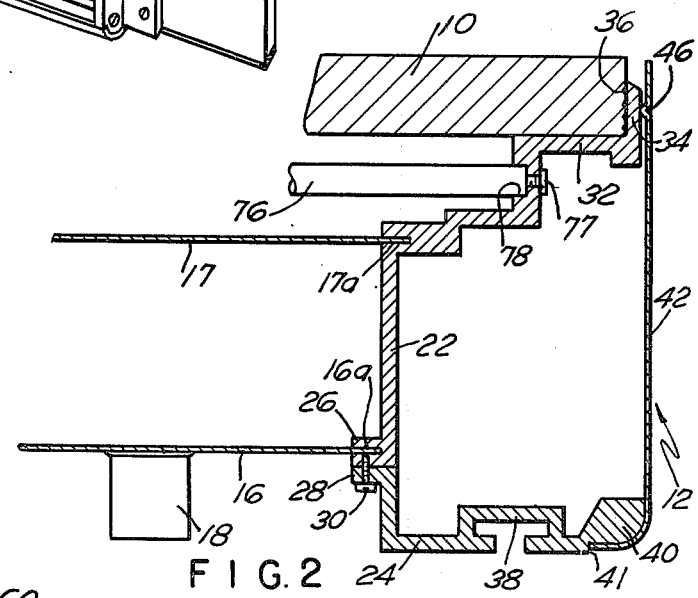
FIG. 2 is a sectional view taken on lines 2—2 of FIG. 1.

The support frame member 12, which is seen more particularly in FIG. 2, consists essentially of two extruded parts 22 and 24 which have interconnecting flanges at 26, 28 respectively, and which are fastened together by a plurality of fasteners 30, there being suitable sealing means such as a silicone type sealant between the mating faces of the flanges 26 and 28. The extrusion 22 is provided with a ledge 32 against which the matrix 10 rests, and outwardly of the ledge there is provided a peripheral lip 34 that extends downwardly along the side of the matrix 10, which lip has a plurality of inwardly facing protrusions thereon which will extend longitudinally of the extrusion to provide gripping teeth. The extrusion 24 has a "T" slot as at 38 and an outer edge at 40 which has a recess at 41 to receive a cover plate 42 and extends from that point down beyond the terminal point of the peripheral lip 34, spacing between the outer face of the peripheral lip 34 being provided by a plurality of indented portions 46.

Figure 3:
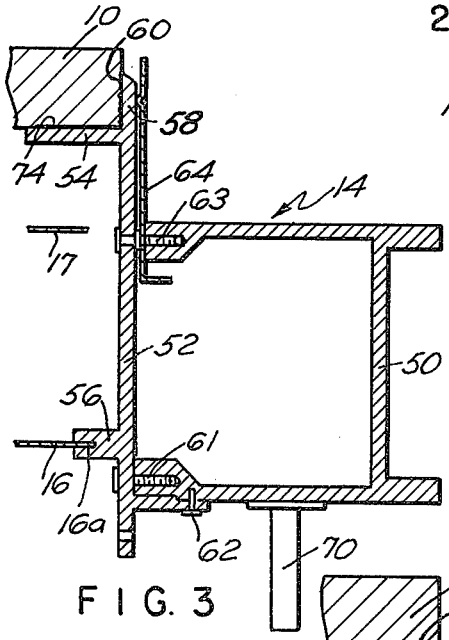
FIG. 3 is a sectional view taken on lines 3—3 of FIG. 1.
Figure 4:
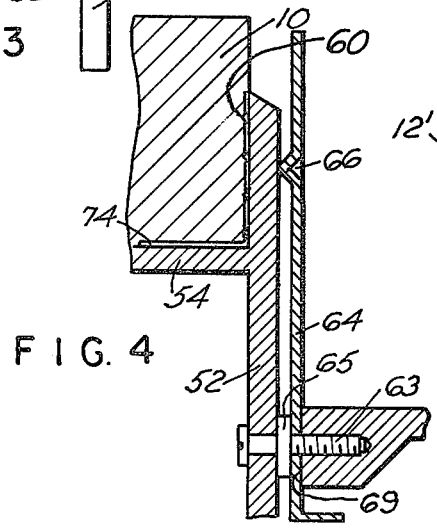
FIG. 4 is an enlarged partial sectional view of a portion of FIG. 3.

The second frame member 14 which is seen in cross section in FIG. 3 is also a two-part extrusion consisting of a U-shaped part 50 and a closing wall part 52 which is provided with a ledge 54, a flange 56 into which the plate 16 is received and in which the protruding lip portion 58 has a plurality of longitudinally extending protrusions 60, which protrusions tend to bite into and grip the matrix 10. The two extrusion parts are suitably held together with fastenings as seen at 61, 62, 63; and the fastening 63 as seen more particularly in FIG. 4, is also used to secure an air knife plate 64 which lies spaced from wall of extrusion 52 by the use of a spacer washer 65 that encircles the fastener 63. In addition, spacing is maintained by a plurality of dimples 66. The two extrusions 50 and 52 when fastened together are also fastened together in a sealing relationship by the utilization of a suitable sealing compound such as a silicone based compound that will be placed between the adjoining portions held together by the fastening 61 and 62, and between the air knife plate 64 and the abuttment on the extrusion 50 about the fastening 63 and along the complete face 69, so that when air is fed through the inlet pipe 70, the only exit will be between the air knife plate 64 and the face of the extrusion 52.

Figure 5:
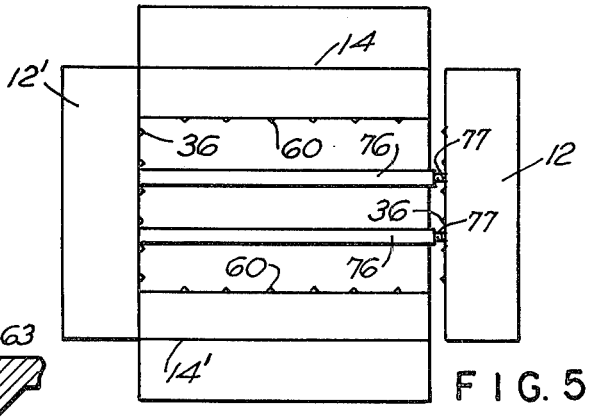
FIG. 5 is a diagrammatic plan view showing the manner in which the burner is assembled.

In assembling the burner of this invention, sealant material will be placed on the ledges 32 and 54 as well as on the peripheral lips 34 and 58, which sealant is seen in enlarged FIG. 4, and is designated 74. Sealant is also placed between where the ledges 54 and 32 may abut as seen at 76 in FIG. 5. Clamping bars 76, 76' are fitted in place, baffle 17 and wall plate 16 are fitted in place and suitably sealed in grooves **17*a* and 16*a* in flanges of the extrusion 12 as well as the grooves 16*a'* in the flanges 56 of extrusion 14. A silicone rubber compound is suitable for sealing. At this point in time, it should be kept in mind that the knife plate 42 is not in place. Proceeding with the assembly, and referring to FIG. 5, screws such as 77 will draw the bars 76 into recesses 78 in extrusion 22 which will force the two extrusions 12 together and indeed also clamp the extrusions 14. To complete the assembly, fasteners 80 will hold the upper part of the extrusions 14 to the extrusions 12 while the engagement of the ledges 54 by the ledges 32 will hold the lower end. The knife plates 42 are then placed in position and sealed to the extrusions 22, 24, preferably by utilizing an epoxy glue on the recess 41**, although fasteners could be utilized if necessary.

For mounting the burner, the T-slot 38 may be fitted with fastener bolts such as 84, 84' and depending upon whether the burner is a part of a continuous installation, or is a single unit, will depend on whether or not cover plates such as 25, 25' are placed on the end of the extrusions 14. If indeed it is anticipated that a continuous set of burners in edge-to-edge relationship are required, then one or both ends would be left open so that upon assembly, a continuous air supply may be afforded for a plurality of burners, the air knives on the frame parts 12 and 12' still requiring separate supply ports which are seen as for example at 71, 71'.

I claim:

1. An infra-red radiant burner comprising a rectangular permeable matrix, a first frame member part extending along two opposite sides and a second frame member part extending along the other two opposite sides, said frame members having a ledge upon which the matrix lies and a peripheral lip with means protruding therefrom inwardly to grip the edge of the matrix, said frame members having grooves facing each other, a flat sheet received in said grooves, said sheet forming a wall, said sheet with said frame members forming a gas combustion mixture chamber with said matrix, said frame members being hollow, means supplying non-combustible gas to and from each of said frame members independently of the other, said frame members each having a narrow slot exit means adjacent said peripheral lip and on the outer side of said lip.

2. A burner as in claim 1 wherein the first frame members have means forming a removable cover plate forming the outer wall thereof.

3. A burner as in claim 1 wherein the first frame members overly the ends of the second frame members.

4. A burner as in claim 1 wherein the exit means are formed by plates spaced from the peripheral lip.

5. A burner as in claim 3 wherein the first frame members have clamping means therebetween that draw them together and into abutting relation with the second frame members.

* * * * *